United States Patent [19]

van Namen

[11] 4,214,691

[45] Jul. 29, 1980

[54] PIN-FEED ASSEMBLY

[75] Inventor: Frederik T. van Namen, Londonderry, N.H.

[73] Assignee: Centronics Data Computer Corp., Hudson, N.H.

[21] Appl. No.: 969,850

[22] Filed: Dec. 15, 1978

[51] Int. Cl.[2] ..... B03B 1/30; B65H 12/38

[52] U.S. Cl. ..... 226/74; 226/100

[58] Field of Search ..... 226/74, 75, 76, 77, 226/78, 79, 80, 100, 170, 171, 172, 173; 352/183

[56] References Cited

U.S. PATENT DOCUMENTS

| | | | |
|---|---|---|---|
| 3,507,431 | 4/1970 | Hepp | 226/74 |
| 3,578,138 | 5/1971 | Cantwell | 226/74 |
| 3,606,122 | 9/1971 | Brewster | 226/74 |
| 3,825,162 | 2/1973 | Hubbard | 226/74 |
| 3,930,601 | 1/1976 | Masuda | 226/74 |
| 3,938,721 | 2/1976 | Staneck | 226/75 |
| 4,130,230 | 12/1978 | Seitz | 226/75 |

*Primary Examiner*—Edward J. McCarthy
*Attorney, Agent, or Firm*—Weinstein & Sutton

[57] ABSTRACT

A pin-feed tractor assembly for advancing a web of indeterminate length through a printing station and including a timing belt having spaced teeth defining interspersed grooves. The drive sprocket is arranged to engage the notches for moving the belt. Sections of the belt between adjacent notches are rigid while the region of the notches is flexible to permit bending of the belt only at the notches, thereby providing equal stresses in the belt. The outer surface of the belt is provided with feed pins arranged at equi-spaced intervals. The pitch of the belt teeth is one-half the pitch of the perforations in the elongated web which receive the feed pins. The pitch circle of the equi-spaced feed pins is smaller than the pitch circle over the rigid flat portions causing the feed pin to retract somewhat from the web before starting its circular path around the drive sprocket to prevent the web from being damaged or torn.

The belt is a molded one-piece member. The design of the tractor assembly is such as to minimize the total number of parts thereby significantly increasing the simplicity of design.

In an alternative embodiment, a mechanical contact pair is incorporated to provide paper out and/or paper counting functions.

As still another preferred embodiment, optical scanning means arranged within a snap fitting body may be mounted to a tractor assembly to likewise provide paper out and/or line counting functions.

26 Claims, 29 Drawing Figures

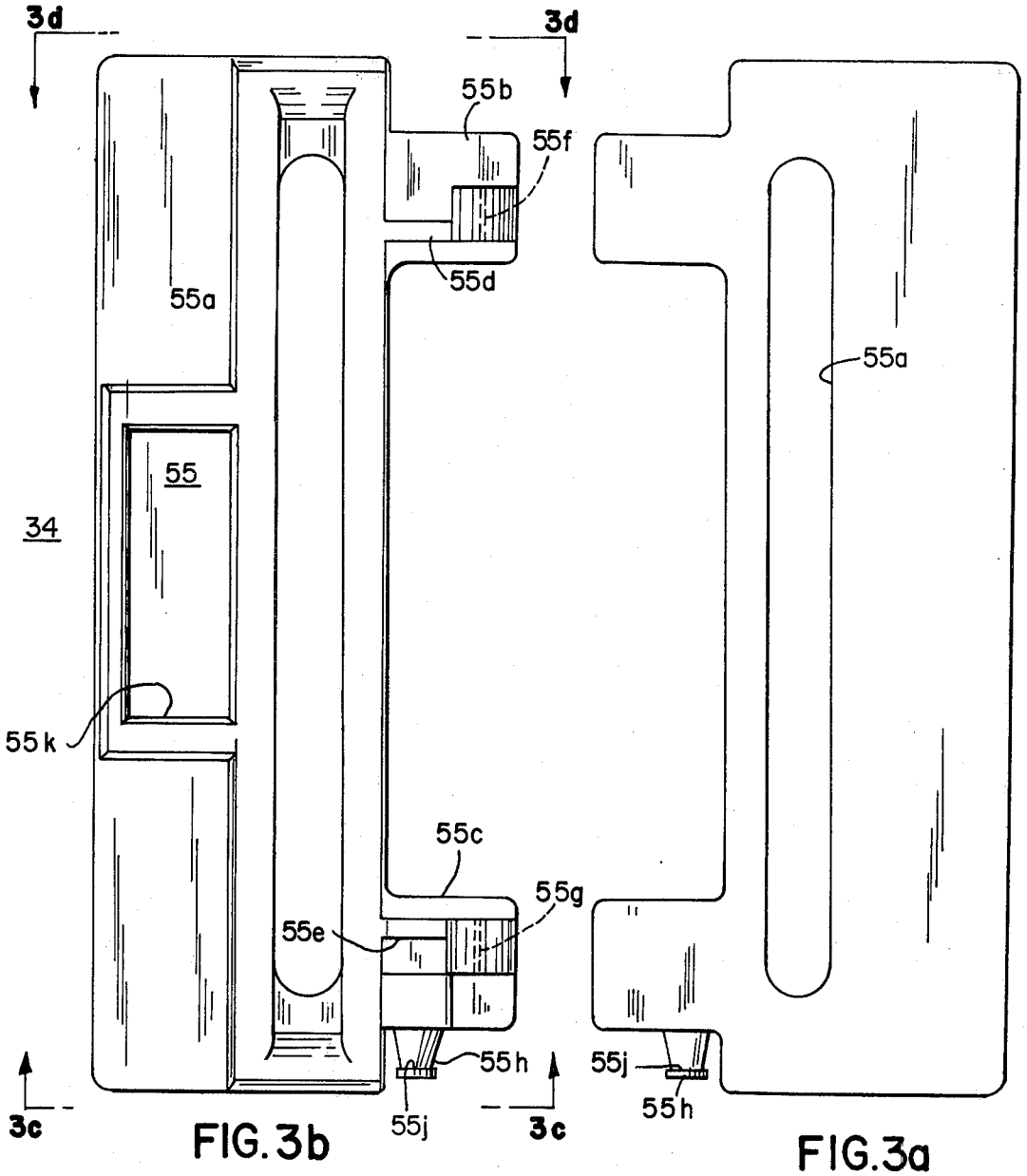
FIG.3b
FIG.3a
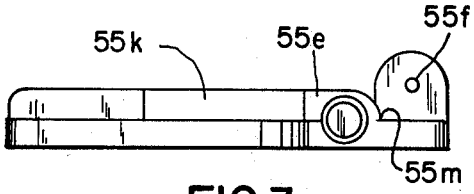
FIG.3c
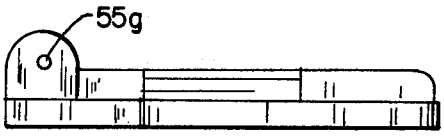
FIG.3d

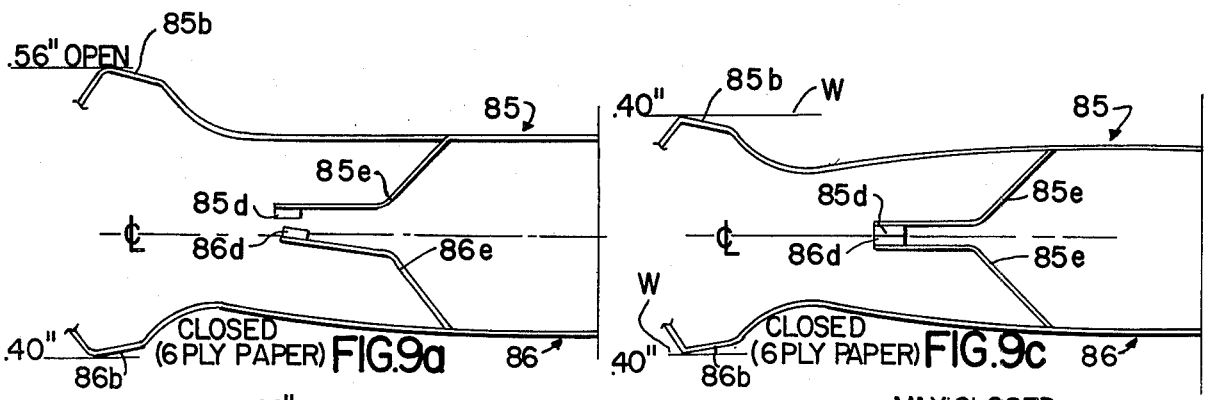
FIG.9a
FIG.9c
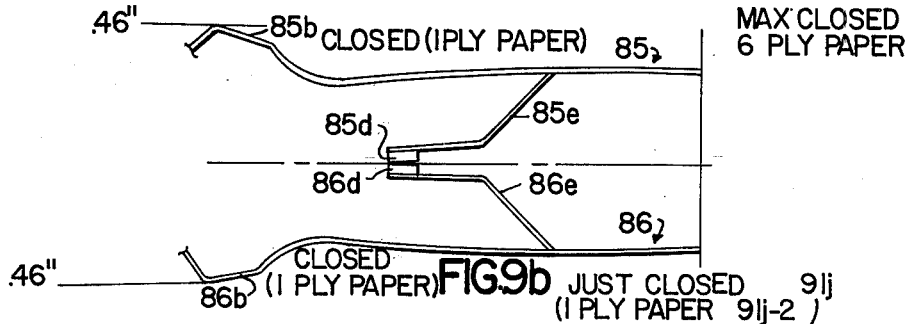
FIG.9b
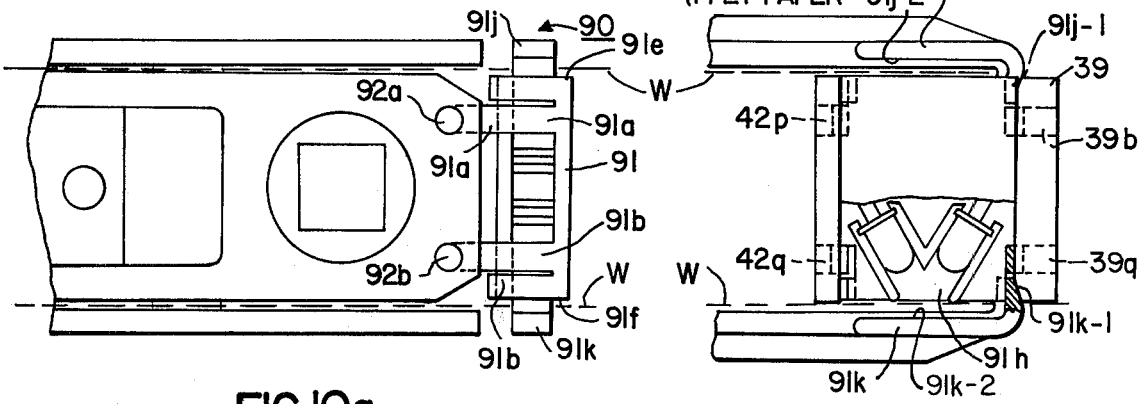
FIG.10a
FIG.10b
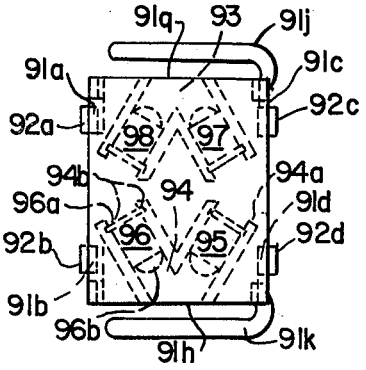
FIG.10c
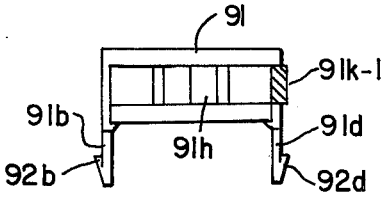
FIG.10d

PIN-FEED ASSEMBLY

BACKGROUND OF THE INVENTION

Pin feed devices have been utilized in many applications for positively and accurately advancing webs of indeterminate length. One conventional pin feed assembly is disclosed in detail in U.S. Pat. No. 3,930,601 issued Jan. 6, 1976 and assigned to the assignee of the present invention. The aforesaid patent discloses a pin feed tractor assembly for moving a web having uniformly spaced perforations along its opposite longitudinal sides. Pins movable by a pin feed belt enter into the perforations to provide positive drive for the web. The inner surface of the belt is provided with a plurality of teeth which cooperate to form spaced notches which are drivingly engaged by the teeth of a sprocket wheel.

The pins are arranged on a pin frame clamped to the belt by a fastening strap. A pair of such pin feed assemblies are arranged along opposite longitudinal edges of the web. The pair of pin feed assemblies differ from one another wherein the left-hand pin feed assembly may not be substituted to serve as a right-hand pin feed assembly. The assemblies are mounted upon a first guide shaft and a second drive shaft for holding the assemblies at the appropriate angular orientation. Means are provided for locking each pin feed assembly to the guide rod at any axial position therealong so as to maintain the pin feed assemblies in properly spaced fashion. Each assembly is provided with a sprocket having a rectangular shaped opening for receiving the drive shaft which preferably has a conforming rectangular shaped cross-section for positively driving both pin feed assemblies.

As the pins mounted upon the belt begin to move about a curve formed by the sprocket, those points along the outside of the curve move along a path of greater circumferential length than the points radially inward therefrom. This results in the pins moving further away from one another as the belt moves about the sprocket resulting in unnecessary stretching and even tearing of the web. As a further example, with tractor assemblies employed to move a laminated web assembly comprised of a multiplicity of plys, it is clear that the surface of the outermost ply moves along a path which is greater in length than the surface of the innermost ply causing undue stretching. In tractor assemblies in which four, five or six plys are being advanced, the outermost ply has been found to tear and hence conventional tractor assemblies of the type described hereinabove are useless under such conditions.

In addition to the above, it should be noted that the tractor assembly of the aforementioned U.S. Pat. No. 3,930,601 contains an extremely large number of components thus greatly complicating its assembly, disassembly and maintenance. Also the pin frames and cooperating belt provide a bulky and somewhat clumsy arrangement. The pins being offset from the belt have a tendency to undergo twisting thereby affecting the uniform feeding of the web.

BRIEF DESCRIPTION OF THE INVENTION

The present invention is characterized by comprising a highly simplified pin feed tractor assembly which avoids all of the disadvantages of conventional tractor assemblies as referred to hereinabove and which is remarkably simple in design.

The pin-feed tractor assembly is comprised of a one-piece molded belt, preferably formed from a plastic material and having timing belt teeth on one surface for engagement with drive and idler sprockets, and feed pins arranged at spaced intervals along the opposite surface for insertion into and positive drive of edge perforated webs. The regions between the notches (provided in the belt engagement by the sprocket teeth) are rigid whereas the region of each of the belt notches is quite flexible. The pitch of the belt teeth is one-half the pitch of the equi-spaced perforations provided along the longitudinal edges of the web and is equal to the sum of the circular surface of the sprocket teeth plus the linear distance between adjacent teeth. The pitch circle of the sprocket is the circle over the top of the teeth while the pitch circle of the feed pins is the smaller circle over the flat portions of the belt causing the feed pins to retract somewhat from the web as it traverses its circular path around the drive sprocket to prevent the web, which moves along a longer linear path than the pin drive belt, from being stretched and torn. The pins have a lower cylindrical section merging into a tangential dome to facilitate their entry into and removal from the web perforations. The belt is preferably formed of a high impact plastic material having a high fatigue life and a low modulus of elasticity.

The tractor body assembly is preferably formed of molded plastic components of a minumum number of parts. The design of the tractor assembly permits its employment as both a right and left hand paper tractor, as opposed to requiring separate designs as per conventional techniques. The one-piece molded belt design eliminates the need for pin frames, whereby the overall size of the tractor assembly is greatly reduced.

In an alternative embodiment, the tractor body assembly may be molded to accomodate mechanical contact means for sensing the presence of the web, thereby serving the function of providing a paper out signal.

In still another preferred embodiment, a snap-in optical sensing assembly arranged to be snap-fittingly joined to the tractor assembly preferably consists of two emitters and two sensors forming first and second reflective sensing means arranged on opposite sides of the tractor. The relation of the sensors relative to the sprocket is such that the upper sensor senses a feed hole, while the lower sensor sees the paper and vice versa. This technique may be advantageously employed for counting and line feeding purposes, as well as paper out detection.

OBJECTS OF THE INVENTION AND BRIEF DESCRIPTION OF THE FIGURES

It is therefore one object of the present invention to provide a novel tractor assembly for positively feeding edged-perforated webs of either single ply or the multiple ply type in a positive high speed manner without danger of tearing.

Still another object of the present invention is to provide a novel tractor assembly of the character described hereinabove wherein the tractor assembly includes a pin feed timing belt designed to cause the pins integrally joined to rigid sections of the belt to move along a curved path whose radius is less than radius of the curved path that the edge perforated web moves as the belt and the web pass about a drive sprocket.

Still another object of the present invention is to provide a novel tractor assembly including mechanical means forming part of the tractor assembly for sensing the presence of the web.

Still another object of the present invention is to provide novel optical means for sensing the presence of the web and for performing and monitoring line feed functions.

The above as well as other objects of the present invention will become apparent when reading the accompanying description and drawings, in which:

FIG. 1 shows a simplified perspective view of the main elements of a printer and incorporating tractor assemblies designed in accordance with the principles of the present invention.

FIG. 2*a* shows a top plan view of the tractor body inner side, and FIGS. 2*b*, 2*c* and 2*d* show side elevation, bottom plan and end elevation views of the tractor body inner side member of FIG. 2*a*.

FIG. 3*a* shows a top plan view of one of the doors of the pin-feed tractor assembly of FIG. 1, and FIG. 3*b* shows a bottom plan view of the door of FIG. 3*a*.

FIGS. 3*c* and 3*d* show end views of the top and bottom ends of the tractor assembly door of FIG. 3*b* looking in the directions of arrows FIGS. 3*c*,3*c* and 3*d*,3*d* respectively.

FIG. 4*a* shows a top plan view of the pin-feed tractor assembly outer body side, and FIG. 4*c* shows a bottom plan view of the body member of FIG. 4*a*.

FIG. 4*b* shows a sectional view of the members of FIGS. 2*a*, 4*a* and 6 when assembled.

Figure 6:
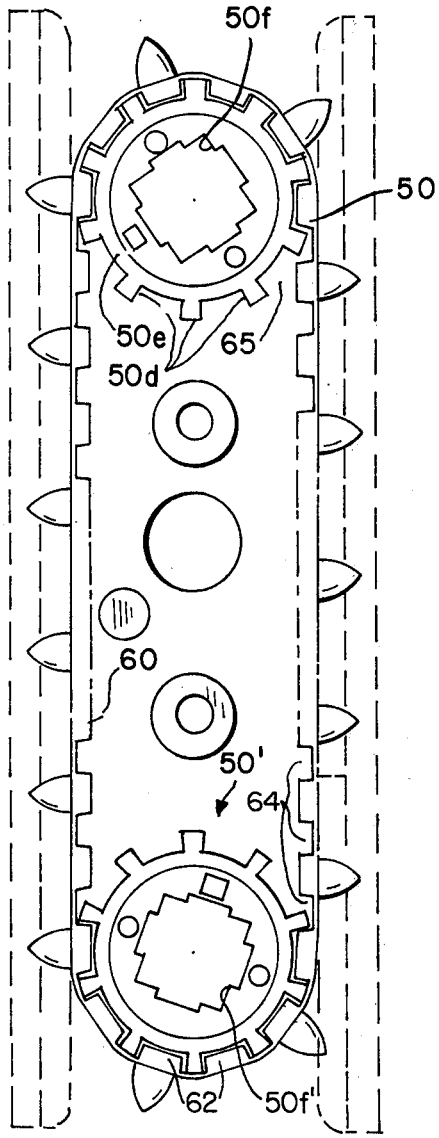
FIG. 6 shows an elevational view of the pin-feed belt and the cooperating sprockets employed in the tractor assemblies of FIG. 1, and showing the manner in which these elements are cooperatively arranged.
Figure 6A:
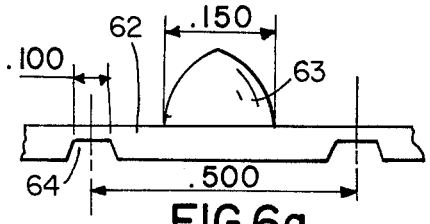
Figure 6B:
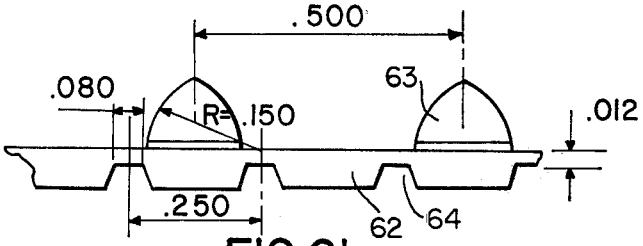

FIGS. 6*a* and 6*b* show portions of the belt of the type shown in FIG. 6 and having different pitches.

Figure 6C:
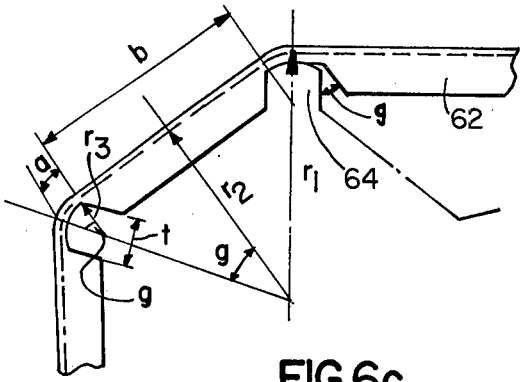

FIG. 6*c* shows a detailed view of a portion of the pin-feed belt which is useful in explaining the advantageous operating characteristics.

Figure 6D:
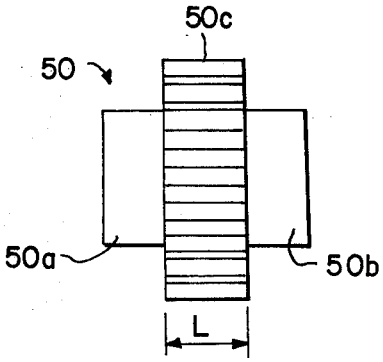

FIG. 6*d* shows a plan view of the sprockets of FIG. 6.

Figure 7A:
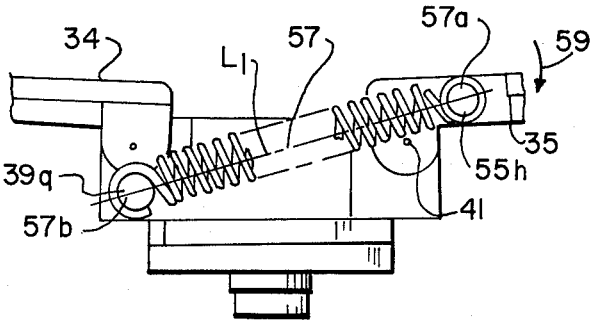

FIG. 7*a* shows an end view of the tractor assembly with the doors in the open position, in which portions of the doors have been shown removed for purposes of simplicity.

Figure 7B:
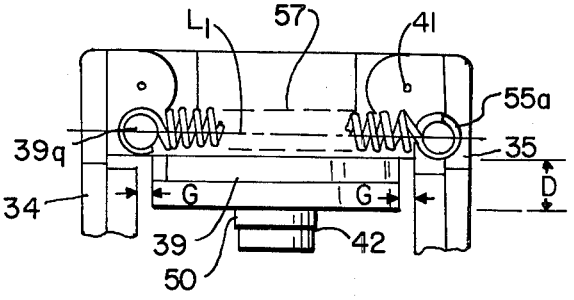

FIG. 7*b* shows the same end view of the tractor assembly of FIG. 7*a* with both doors in the closed position.

Figure 1:
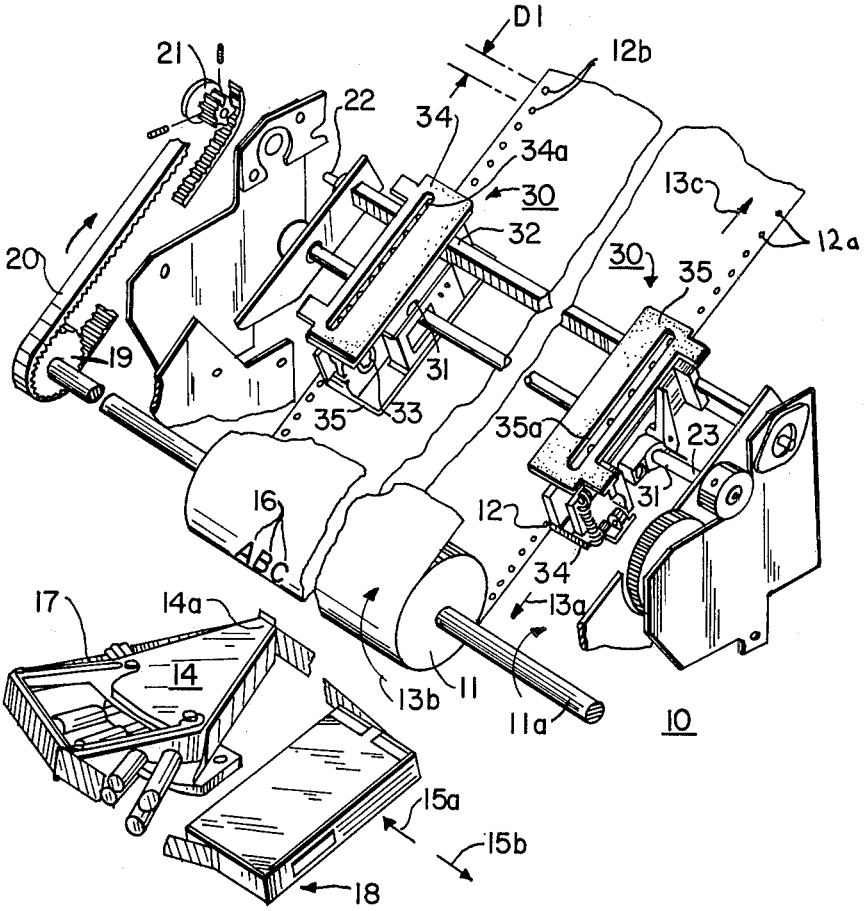
Figure 8A:
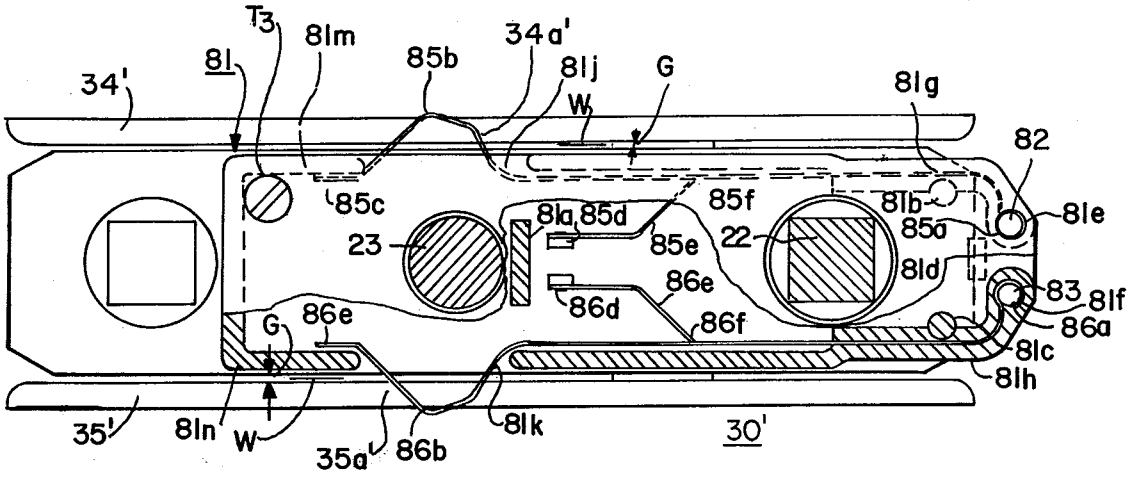
Figure 8B:
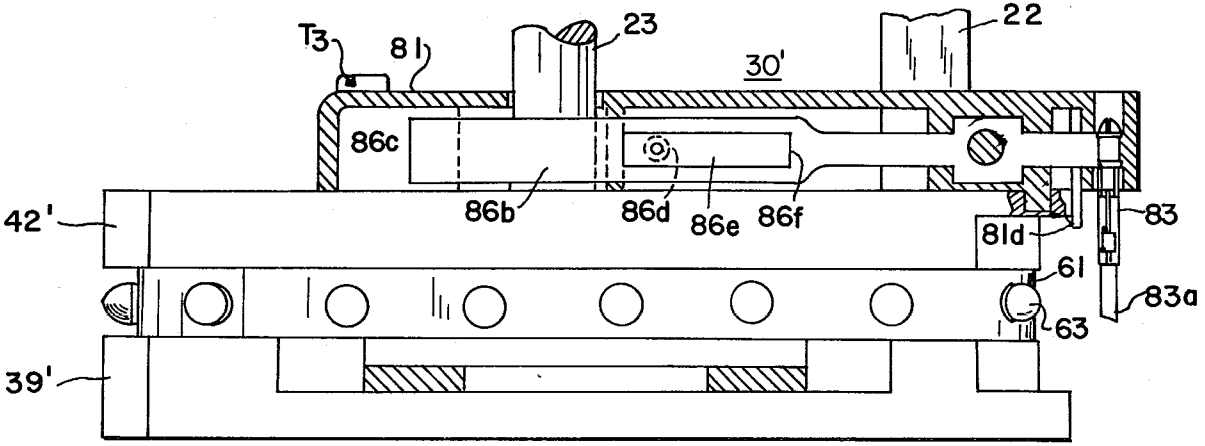

FIGS. 8*a* and 8*b* show partially sectionalized top plan and elevational views respectively of an alternative embodiment of the tractor assembly of FIG. 1 and incorporating mechanical paper sensing means.

FIGS. 9*a*, 9*b* and 9*c* show various sensing positions of the mechanical paper sensing means of FIGS. 8*a* and 8*b*, and which are useful in describing the manner of operation.

FIG. 10*a* shows an end view of a snap-on sensing unit arranged at one end of a pin-feed tractor assembly.

FIG. 10*b* shows a partially sectionalized top plan view of the assembly of FIG. 10*a*.

FIG. 10*c* shows the arrangement of FIG. 10*b* wherein the sensing elements are shown in greater detail.

FIG. 10*d* shows a partially sectionalized end view of the snap-on unit of FIGS. 10*a*–10*c*.

DETAILED DESCRIPTION OF THE INVENTION AND THE PREFERRED EMBODIMENTS

FIG. 1 shows some of the essential elements of printer assembly 10 which includes a platen 11 for advancing a paper web 12 fed in the direction of arrow 13*a* beneath the platen and about the front portion thereof as shown at 13*b* so as to be moved in the direction of arrow 13*c* for storing and/or removal from the printer.

A print head 14 is arranged upon a carriage (not shown) to reciprocate in the left and right hand directions as shown by arrows 15*a* and 15*b* respectively. The print head moves across the paper web to print characters 16 and/or graphic patterns upon the surface of the web 12. An inked ribbon 17 fed from a ribbon cartridge 18 is designed to move across the nose 14*a* of the print head to transfer ink to the web 12 as the print wires of the print head 14 are moved towards the web 12 in order to form the aforesaid characters or graphic patterns.

The platen 11 is mounted to rotate about shaft 11*a* which in turn rotates a pulley 19. A timing belt 20, entrained about pulley 19 and pulley 21, serves to couple rotation of shaft 11*a* to the tractor drive shaft 22.

A pair of pin-feed tractor assemblies 30, 30 are arranged at spaced positions along the tractor drive shaft 22 and an elongated positioning shaft 23. Each tractor assembly is provided with a substantially centrally located opening 31 for receiving guide shaft 23. The tractor assemblies are substantially identical to one another and are arranged upon shafts 22 and 23 in mirror image fashion so that the upper sprocket drive opening 32 of the both pin-feed tractor assemblies received drive shaft 22 while the lower sprocket drive opening 33 is not used for either driving or guiding purposes.

The pin-feed tractor assemblies 30, 30 are provided with driving pins arranged at spaced intervals about the pin-feed belt, which will be more fully described, and are arranged at spaced intervals equal to the intervals between the edge perforations 12*a* and 12*b* provided along the right- and left-hand edges respectively of the web 12.

The paper web 12 is initially loaded into the printer 10 by lifting the lower and the upper doors 34 and 35 of the left- and right-hand tractor assemblies 30, 30 to position the web 12 upon the pin-feed belts to that the edge perforations 12*a* and 12*b* line up with the pins 63 on the belt, whereupon the doors 34 and 35 may be closed. The doors 34 and 35 are provided with elongated slots 34*a*, 35*a* through which the web feed pins extend as they move between sprockets. The slots 34*a* and 35*a* provided in doors 34 and 35 cooperate with pins which extend therethrough to permit the paper web 12 to be guided and fed in the direction shown by arrows 13*a*, 13*b* and 13*c* so that the paper web 12 does not come dislodged from the pins. The pins move about the upper and lower sprockets (to be more fully described) of the assemblies 30, 30 such that as each pin enters into the lower end of each slot and enters into an opening in the web a feed pin at the upper end is moving out of an associated edge perforation. This arrangement provides for a positive drive for the web, assuring accurate advancing of the web, even through small increments.

Each tractor assembly 30, 30 is comprised of inner and outer side members 37 and 38 and a pair of doors 34 and 35. The inner side member 37 is shown in FIGS. 2a–2d and is comprised of a main body portion 39 having sprocket supporting openings 39a and 39b and a centrally located positioning shaft opening 39c. Openings 39d and 39e respectively receive threaded fastening members and opening 39d is tapped to threadedly engage a threaded fastening member (not shown).

Figure 2A:
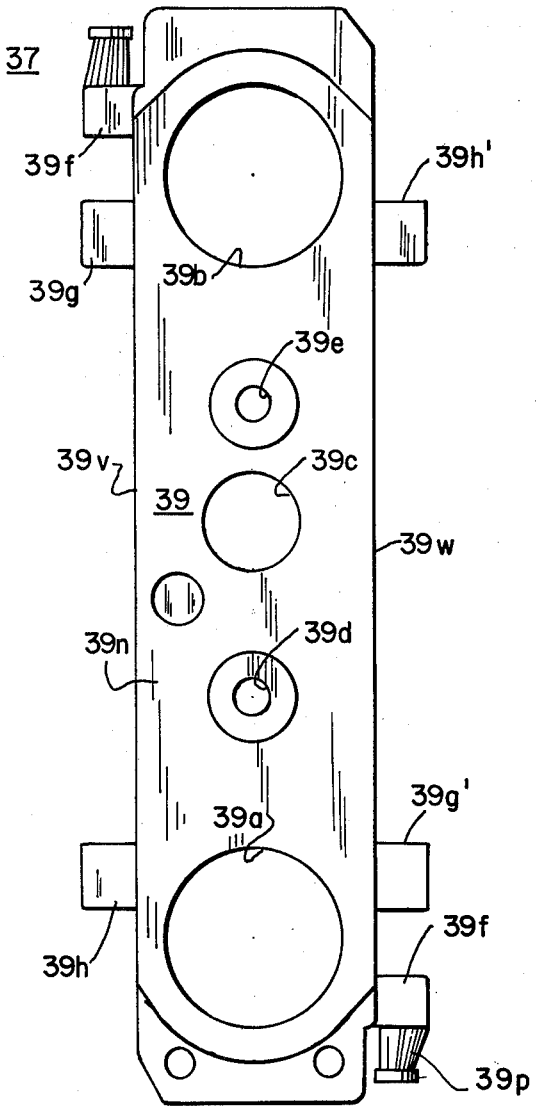

The left hand side of body 39 is provided with a pair of projections 39f and 39g at the upper left hand end relative to FIG. 2a and a single projection 39h at the lower left hand end. The right hand surface is provided with a pair of projections 39f' and 39g' which are substantially mirror images of projections 39f and 39g. In a like manner the sole projection 39h' at the upper right hand end is substantially identical to and the mirror image of the projection 39h.

Figure 2B:
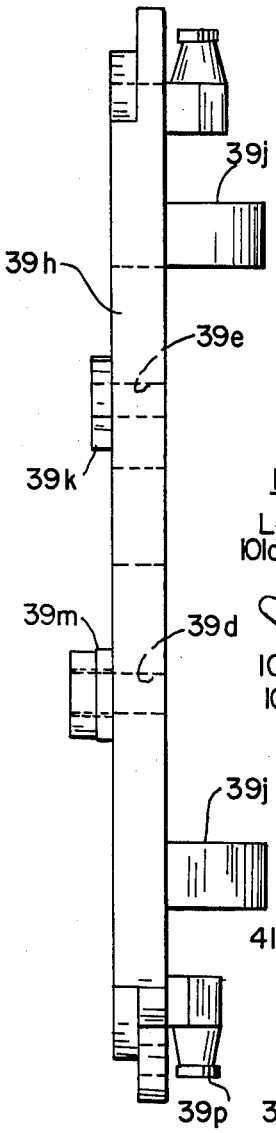
Figure 2C:
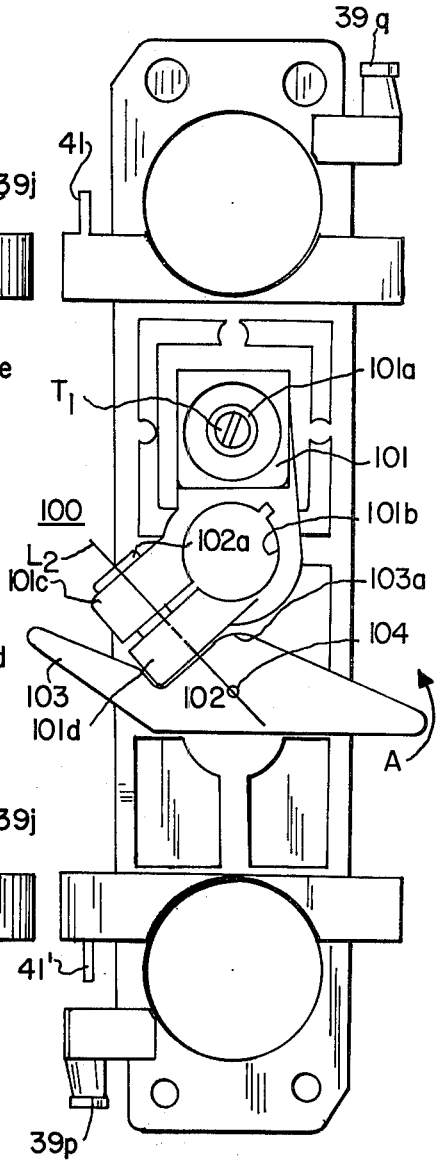
Figure 2D:
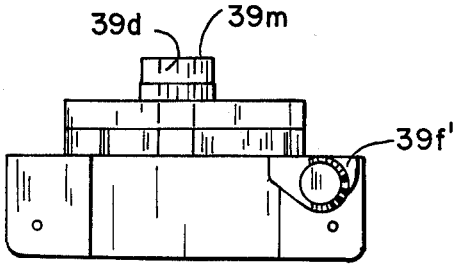

The projections 39g and 39h' constitute the left-hand ends of a pair of large projections 39j and 39j', both of which extend outwardly from one major surface of member 39 as shown best in FIGS. 2b and 2c. Each of these projections 30j, 30j' is provided with an opening for respectively receiving a mounting pin 41 and 41' for pivotally mounting a cooperating door member to the inner side member.

Figure 4A:
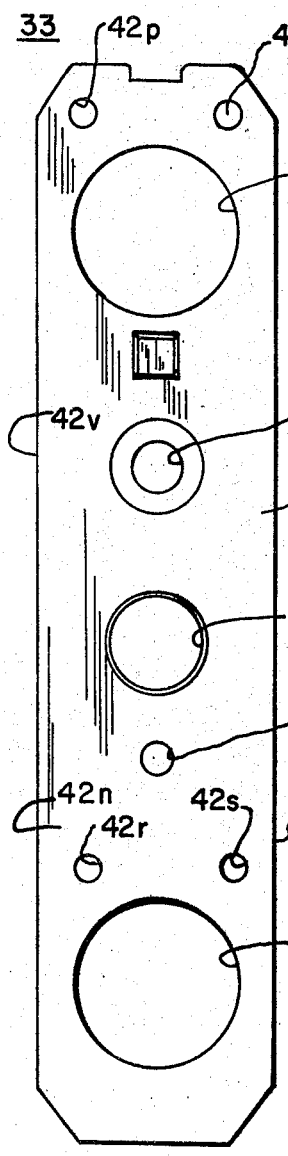
Figure 4B:
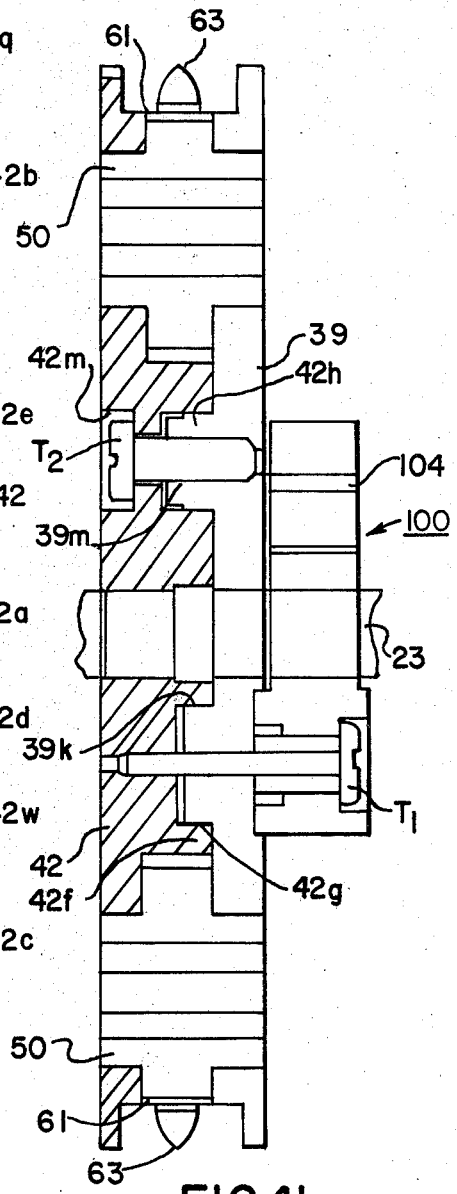
Figure 4C:
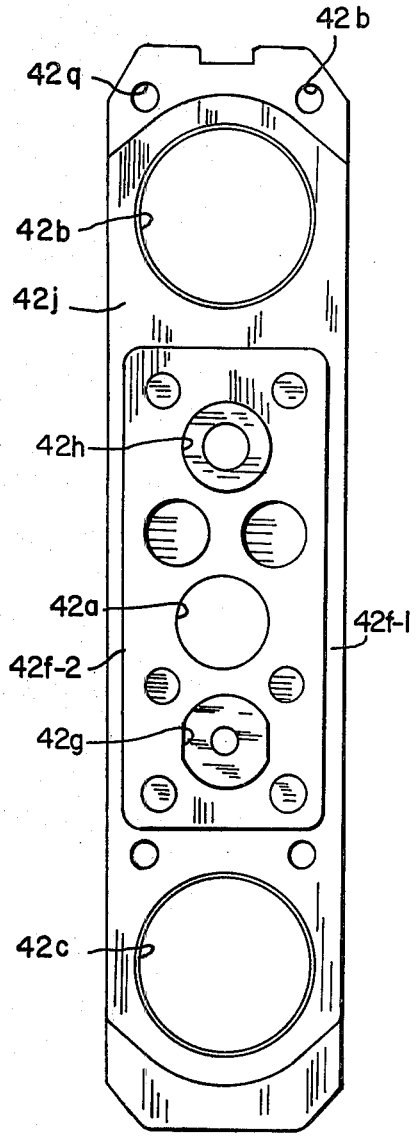

The outer side member 38 shown in FIGS. 4a through 4c is comprised of a solid unitary body 42 having a central opening 42a and two sprocket supporting openings 42b and 42c respectively. Sprocket supporting holes 42b and 42c are respectively aligned with sprocket holes 39b and 39a of the inner side member 37 when these members are interfitted with one another as will be more fully described, with respect to FIG. 4b.

The central opening 42a similarly is in alignment with the central opening of 39cof inner side member 37. Openings 42d and 42e align with openings 39d and 39e respectively to receive the aforementioned fastening means.

The inner side member 37 (FIGS. 2a–2d) is provided with a pair of cylindrical shaped projections 39k and 39m which surround the openings 39e and 39d respectively. As can best be seen in FIGS. 2b, and 4b the length of projection 39m is greater that the length of projection 39k. In a similar fashion, one major surface of outer side member 38 (FIG. 4c) is provided with an elongated substantially rectangular shaped projection 42f having recesses 42g and 42h of different depths. The design of the members 39 and 42 is such that the shallow cylindrical shaped recess 42g in body 42 receives the shorter cylindrical shaped projection 39k while the deeper cylindrical shaped recess 42h receives the cylindrical projection 39m, thereby assuring that the two members are properly interfitted and further preventing their improper assembly.

As shown in FIG. 6d, the sprocket 50 is comprised of two outer cylindrical projections 50a and 50b on opposite sides thereof, and having a central portion 50c provided with interspersed teeth 50d and recesses 50e, shown best in FIG. 6. Teeth 50d are radially aligned and are arranged at equi-angular spaced intervals about the sprocket portion 50c. The sprocket members 50 are designed to be freewheelingly mounted within the aforementioned sprocket supporting openings such that one such sprocket 50 has its cylindrical projection 50a rotatably mounted in opening 42a of the outer side member 42 and has its opposite cylindrical projection 50b rotatably mounted within sprocket opening 39b in the body 39 of inner side 37. The lower sprocket member 50'(see FIG. 6) is mounted in a similar fashion. As can best be seen in FIG. 6, the sprocket members 50, 50' are provided with a square shaped central opening 50f 50f' designed to conform to the rectangular cross-sectional configuration of the tractor drive shaft 22 shown in FIG. 1, said shaft being slidably inserted into opening 50f.

The top surface of projection 42f bears against the cooperating surface 39n of body 39 carrying projections 30k and 39m and serves to space surfaces 42j and 39n by a distance D (see FIG. 7b) which is preferably slightly greater than the axial length L of the sprocket portion of 50c of each sprocket 50 50' to prevent the sprocket members 50, 50' from becoming dislodged from the region between members 39 and 42 and yet to permit the sprockets 50, 50' to be rotatably therein in a freewheeling fashion.

As was described hereinabove, each pin-feed tractor assembly 30 is provided with a pair of doors 34 and 35. The doors are identical to one another except that they are hingedly mounted upon the inner side body 39 in mirror image fashion. As shown best in FIGS. 3a through 3d, door 34 is comprised of a one-piece member 55 having an elongated slot 55a through which the pins of the pin-feed belt protrude, in a manner to be more fully described. One side of the door 34 is provided with extensions 55b and 55c each having downwardly depending projections 55d and 55e respectively. Each projection is provided with an opening 55f and 55g for receiving the pins 41, 41' shown in FIG. 2c.

One edge of extension 55c is provided with a truncated conical-shaped projection 55h having a shoulder 55j spaced inwardly from its free end for receiving and supporting one end of a helical spring 57 as will be more fully described.

The other side of the door is provided with an elongated slot 55k in which the arm of the contact assemblies can descend.

Projections 55d and 55e are axially aligned with projections 39g and 39h of inner side member 39 so that openings 55f, 55g receive pins 41, 41' to provide for the swingable mounting of door 34 to body member 39. The remaining door of the tractor assembly 30 is mounted in a similar fashion.

As shown best in FIGS. 2b and 2c, body member 39 is provided with similar conical shaped projections 39p and 39q which are each adapted to receive one end of a spring member 57 (see FIGS. 7a and 7b) for spring loading the doors 34, 35 and, through the use of an over center arrangement, for urging each door 34 and 35 toward either the fully opened or fully closed position.

FIGS. 7a and 7b show doors 34 and 35 mounted to body member 39. Helical spring 57 has a first hooked shaped end 57a encircling conical shaped projection 55h of door member 35. A hooked shaped member 57b at the opposite end of the helical spring 57 is mounted upon truncated projection 39q provided on body 39. As can clearly be seen, the pivot pin 41 is positioned to the right of an imaginary line $L_1$ extending through the central axes of projections 57a and 57b causing spring 57 to maintain the door in the open position. By pivoting door 35 in the clockwise direction as shown by arrow 59 from the position of FIG. 7a to the position of FIG. 7b, the hooked end 57a of spring 57 moves with projection 55h whereupon, once the spring moves to the opposite side of centerline $L_1$, the opposite over center condition is thereby obtained, causing door 35 to be maintained in the closed position shown in FIG. 7b. Even though the shortest distance between projections 39*q* 55*a* exists when the doors are in the closed position, spring 57 is of a length so as to still be under tension, i.e. so as to be expanded beyond the rest condition, to exert a pulling force between the projections 55*h*, 39*g* to maintain the door 35 in the closed position. Door 34 in mounted upon the left hand side of body member 39 in a similar fashion, and utilizes the same over center principle to maintain the door 34 in either the fully opened or fully closed position. The interior surface 55*k* of each door is spaced from the edges of 39*v*, 42*v*, and 39*w*, 42*w* of members 39, 42 to allow a gap space G suitable for the free movement of either a single ply or a multiple ply web 12. This gap G is provided by the engagement of the end surfaces 39*g*, 39*h* with cooperating portions of the confronting surface 55*m* of the door member 55.

The side surfaces 42*f*-1, 42*f*-2 of projection 42*f* on member 42 serves as a sliding surface for the trapezoidal-shaped projections 62 of pin feed belt 60 as the belt is moved by the drive sprocket. The surfaces 42*f*-1, 42*f*-2 (FIG. 4*c*) are recessed relative to end surfaces 39*v*, 42*v* and 39*w*, 42*w* so that the outer surface of belt portion 61 is flush (i.e., coplanar) with end surfaces 39*v*, 42*v* and 39*w*, 42*w*. Thus the clearance gap G between the outer surface of belt 60 and the inner surface of door 55 (when closed) is the same as set forth above.

The manner in which the belt 60 is entrained about the sprockets 50, 50' is shown best in FIG. 6. FIGS. 5 and 6*a* through 6*c* show further details of the pin feed belt 60. Belt 60 is a one-piece member preferably formed through a molding operation. Belt 60 is provided with trapezoidal shaped projections 62 along the interior surface. Each trapezoidal projection 62 is separated from the adjacent projection 62 by a trapezoidal shaped recess 64. Each portion of the belt 60 having a trapezoidal shaped projection 62 is substantially rigid and undergoes no noticeable flexing.

Figure 5:
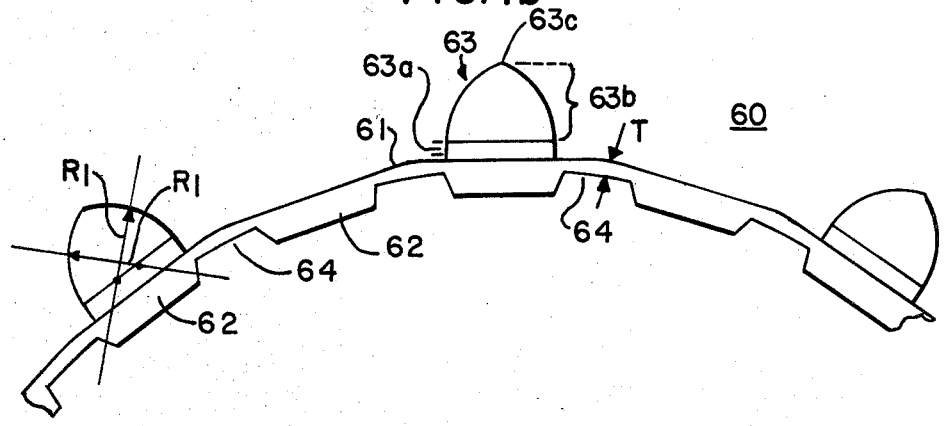
FIG. 5 shows an enlarged view of a portion of a pin-feed belt employed in the tractor assembly shown in FIG. 1.

The opposite surface of every other trapezoidal projection 62 is provided with a pin 63 having a cylindrical shaped base portion 63*a* and a tapered portion 63*b*. The radius of curvature R1 for the pins 63 are shown in FIG. 5 and form a dome-shaped tapered pin 63 which tapers to a point 63*c* at the top end. The surface of the cylindrical portion of 63*a* merges with and is tangential to the surface defining the base portion of the pin 63. The length of the teeth 50*d* of sprocket 50 is sufficient to allow each trapezoidal projection 62 to descend into the region between adjacent teeth 50*d*.

The thickness T of the central portion 61 of the pin-feed belt can be seen to be minimal in the region of each trapezoidal shaped notch 63. This thin web-like portion 61 of the belt 60 is quite flexible in the region of each notch 64. The elongated trapezoidal-shaped teeth 62 provide equal stresses along the belt 60. The pitch (P) of the belt 60 is half the pitch of the openings 12*a* in web 12 and is equal to the sum of the circular tooth surface and the linear distance between the teeth sprocket measured on the pitch line. P may be represented as $P=2a+b$, where a is the circumferential length or linear distance over one-half of each of the adjacent teeth 50*d* and b is the length of one trapezoidal section 62 between adjacent teeth. The pitch of the paper web 12 is represented by the distance D1 as shown in FIG. 1 and represents the distance between the centers of adjacent perforations 12*a* and 12*b*. As a result of this design, the feed-pins 63 retract from the perforations 12*a*, 12*b* in perforated web 12 before the pins 60 begin moving about the circular path around the sprocket 50.

The sprocket 50 shown in FIG. 6 contains 10 teeth 50*d* and is arranged to move the edge perforated web (12) 2.500 inches per complete revolution. The web 12 travels on top of the belt 60 at a distance of 0.408 inches from the center of the sprockets 50, 50'. The root of the feed-pins 63 rotates on a radius of 0.395 inches creating a 0.013 inch space between the belt 60 and the papar web 12 at the moment the pin starts its rotation. Thus the web 12 experiences no stretching as the pin-feed belt 60 moves about the curved path defined by sprocket 50. Any pronounced effect in dealing with multi-ply webs is thus totally compensated for by the novel design described herein. The tractor assembly members 39, 42 (FIG. 4*b*) are secured together by a threaded fastener $T_1$ which extends through openings 39*e* in member 39 and threadedly engages tapped opening 42*d* in member 42. A second threaded fastener T2 extends through opening 42*k* in member 42 and threadedly engages tapped opening 39*m* in member 39. The recess 42*m* in member 42 provides a recess for the head of the threaded fastener T2.

The threaded fastener $T_1$ also serves to mount a locking assembly 100 to the body member 39 (FIGS. 2*c* and 4*b*), said assembly 100 including a body 101 having an opening 101*a* for receiving fastener $T_1$ and an opening 101*b* for slidably receiving positioning rod 23. The portion of body 101 extending beyond opening 101*b* is formed to define a pair of bifurcated arms 101*c*, 101*d*. A thin member 102 extends through slots in arms 101*c*, 101*d* and is prevented at one end from sliding out of said slots by means of an enlarged end portion 102*a*. The opposite end of member 102 extends through a slot in locking lever 103, and this latter end is secured to locking lever 103 by pin 104.

By rotating lever 103 counter-clockwise as shown in FIG. 2*c* by arrow A, its V-shaped surface 103*a* urges arms 101*c*, 101*d* together to reduce the diameter of opening 101*b*. The lever 103 is held in this position due to the over-center arrangement between V-shaped surface 103*a* and an imaginary line $L_2$ extending through pin 104. When lever 103 is rotated clockwise, i.e. in the direction opposite that of arrow A, V-shaped edge 101*a* moves to the right of imaginary line $L_2$, allowing bifurcated arms 101*c*, 101*d* to move apart and thereby allow opening 101*b* to be enlarged.

By enlarging opening 101*b* the tractor assemblies 30, 30 may be moved along guiding rod 23 (FIG. 1) to be positioned to align the pins with the openings 12*a* in the web being inserted into the printer. Once the assemblies 30, 30 are properly positioned they may be locked into place by moving the locking lever 103 counterclockwise as described above.

In the alternative embodiment shown in FIG. 6*a* the feed belt 60 is designed for use with a sprocket 50 having five (5) equispaced teeth 50*d*. For a sprocket 50 with 5 teeth 50*d*:

$a = .050 \qquad \phi = 36° \qquad b = .100$ $$r_3 = \text{tooth radius} = \frac{.050 \times \frac{360}{36}}{2\pi} = .0796$$

$$r_2 = \text{tooth pitch radius} = \frac{.200}{\tan 36°} + r_3 = .355$$

$$r_1 = \text{belt pitch radius (sprocket pitch)} = \frac{.200}{\sin 36°} + r_3 = .420$$

$$\Delta r = r_1 - r_2 = .065$$

$$\Delta l = \text{belt length change} - .500\left(1 - \text{cosarctan}\frac{65}{500}\right) = 0.0042$$

-continued $t$ = tooth width = $2r_3 \sin \phi$ = .0936

For a ten (10) tooth sprocket 50:

$a = .04 \qquad b = .170 \qquad \phi = 18°$ $$r_3 = \frac{.04 \times \frac{360}{18}}{2\pi} = .12732$$

$$r_2 = \frac{.085}{\tan 18°} + r_3 = .38892$$

$$r_1 = \frac{.085}{\sin 18°} + r_3 = .40239$$

$$\Delta r = r_1 - r_2 = .0135$$

$$\Delta l = .500\,(1 - \text{cosarctan}\,\frac{13.5}{500}) = .0002$$

$$t = .07868$$

Thus the pins 63 experience a downward movement as they move between the teeth 50*d* of the sprockets 50, which downward motion begins before the pins 63 reaches the sprocket 50 causing the pins 63 to run around the sprocket 50 along a smaller radius than the pitch circle.

The presence or absence of the paper web 12 is sensed by the contact assembly 70 shown in FIGS. 8*a* and 8*b* and 9*a* through 9*c*. The tractor assembly 30' is similar to that shown previously and comprises body members 39' and 42' as well as doors 34' and 35'. A hollow enclosure 81 is secured to member 39' by means of projections 81*b*–81*d* force-fitted into openings in body member 39' of conforming shapes, and by means of two threaded fasteners $T_3$ engaging opening 42*r* and 42*s* in member 42' (see FIG. 4*a*).

A pair of pins 82 and 83 extend through openings 81*e* and 81*f* in housing 81 and are snap fitted into the rounded ends 85*a*, 86*a* of the contact assemblies 85 and 86, which comprise leaf spring arms which have their right-hand portions extending through recesses 81*g*, 81*h* of housing 81 and have bent portions 85*b*, 86*b* extending through openings 81*j*, 81*k* in the opposite sidewalls 81*m*, 81*n* of housing 81. The free end portions 85*c*, 86*c* extend along the interior surfaces of sidewalls 81*j*, 81*k*.

The cooperating contacts 85*d*, 86*d* are mounted upon the free ends of contact arms 85*e*, 86*e* whose opposite ends are integrally joined to the flexible leaf arms at 85*f*, 86*f*, having been punched out of the centers of leaf arms 85, 86 as shown best in FIG. 8*b*.

The leads 82*a*, 83*a*, connected to pins 82, 83 couple the contact assemblies into an electrical circuit.

As shown in FIGS. 8*a* and 9*a*, when no paper web is provided in at least one of the gaps G, the bent portions, 85*b*, 86*b* extend through openings 81*j*, 81*k* and into the cooperating elongated slots (34*a'* and 35*a'*) provided in doors 34', 35' (as shown in FIG. 3*a*).

When a paper web W (single ply) is inserted in the gap G between the confronting surfaces of doors 34', 35' and housing sidewalls 81*m*, 81*n* the web W forces the bent portions 85*b*, 86*b* inwardly urging contacts 85*d*, 86*d* into engagement, to close an electric circuit (or open a normally closed electrical circuit) to cancel a "paper out" signal.

FIG. 9*c* shows the positions assumed by the contact assemblies 85, 86 when a 6-ply web is inserted into gaps G, G (see FIG. 8*a*).

In FIG. 9*a* it should be noted that as long as one of the leaf arms (in this case leaf arm 85) senses the absence of the paper web, contacts 85*d*, 86*d* are disengaged, even though the paper web W is still moving through the region between door 35' and sidewall 81*n*. Obviously the absence of the paper web W in both gaps G, G allows the contacts 85*d*, 86*d* to move further apart.

FIGS. 10*a*–10*d* show an optical sensor assembly 90 comprising a hollow housing 91 with four exterior resilient projections 91*a*–91*d* each having a cylindrical button 92*d*–92*a* at its free end. Each button 92*a*–92*d* is adapted to be snap-fitted into an opening in the tractor assembly housing. For example, buttons 92*a*, 92*b* extend into openings 42*p*, 42*q* in body member 42 (see also FIGS. 4*a* and 4*c*). Similar openings 39*p*, 39*q* in body member 39 receive buttons 92*c*, 92*d*.

The exterior sidewalls 91*e*, 91*f* of housing 91 are provided with openings 91*g*, 91*h*. A pair of flat enlongated projections 91*j*, 91*k* extend over the length of sidewalls 91*e*, 91*f* and have their right-hand ends 91*j*-1,91*k*-1 integrally joined to associated corners of housing 91. The flat projections 91*j*, 91*k* serve to prevent light from reaching the sensing members to be described hereinbelow.

Noting FIGS. 10*b* and 10*c*, the interior of housinb 91 is provided with first and second V-shaped grooves 93, 94.

An emitter 95 (such as an LED) has its base 95*a* fitted into slots 94*a* and directs light through opening 91*h*.

A light sensitive element 96 has its base portion 96*a* fitted into slots 94*b* and its adapted to sense light reaching its light sensitive heed portion 96*b*. The interior surfaces 91*j*-2, 91*k*-2 of flat projections 91*j*, 91*k* serve as non-reflective surfaces. The openings 91*g*, 91*h* are aligned with the pins 63 of pin feed belt 60 and hence are aligned with the openings 12*a* in edge perforated web 12 (see FIG. 1).

The sensor element 97, light emitter 98 combination arranged in V-shaped groove 93 is substantially identical to the elements 95, 96 described above.

Each pair of elements 95, 96 and 97, 98 form a reflective sensor assembly. The placement of the sensor assemblies in the sensor unit housing 91 is such that one pair (95, 96) senses the perforations in web W on one side of the pin feed tractor assembly while the other pair (97,98) senses the perforations in the web W arranged on the opposite side of the pin feed tractor assembly. The relationship between the sensors, when the web W is present, is such that as the sensors 95, 96 sense a perforation in web W, the sensors 97, 98 see the web W and vice versa. When a perforation in the web W is present the non-reflective surface (91*j*-2, for example) reflects less light than the surface of web W to activate sensor 98, for example. As an alternative, the surfaces 91*j*-2, 91*k*-2 may be of higher reflectivity so that light reflected from the surfaces 91*j*-2 or 91*k*-2 (in the presence of a perforation 12*a*) is more than that reflected by the web W. Thus either arrangement may be employed, for examle, to suit the convenience of the sensing circuitry (not shown).

The relationship of the sensors 96, 98 set forth hereinabove enables a line count to be provided and a count of six (6) lines per inch is possible with the present design. Thus a positive indication of line feed operations is available through use of the snap-on sensor assembly 90. In addition, the direction of motion of the web W is also capable of being determined, through the use of the sensor assembly 90 with appropriate logical circuitry (not shown).

What is claimed is:

1. A pin feed tractor assembly for advancing a web having equispaced perforations extending along the direction of movement of the web, said assembly comprising:

a frame;

first and second sprockets rotatably mounted upon said frame at spaced intervals;

each sprocket having equispaced radially aligned teeth;

a timing belt entrained about said sprockets;

said belt having integrally joined alternating flexible and rigid belt portions, said flexible portions being thinner than said rigid portions and forming therewith notches along the interior surface of the belt, each of said notches being adapted to receive a tooth of a sprocket with sufficient clearance therebetween such that said timing belt bends at said notches as said timing belt moves about the sprockets;

the exterior surface of said timing belt having projecting pins for insertion into associated perforations in said web to advance said web; and said projecting pins are arranged at selected positions intermediate said notches to prevent the web from being stretched or torn by said projecting pins as the timing belt moves about one of t sprockets.

2. The tractor assembly of claim 1 wherein each tooth of said sprockets has it outer end extending into a notch, the end surface of the outer end of each tooth being curved whereby the flexible portions of said belt assumes a curvature conforming to the curvature of the engaging end surface of a tooth to limit the bending of the flexible portions as they move around a spocket.

3. The pin feed tractor assembly of claim 1 wherein the projecting pins are integrally formed upon every other rigid belt portion while the remaining interspersed rigid belt portions have substantially flat surfaces along the exterior side of the timing belt.

4. The pin feed tractor assembly of claim 1 wherein the base of said projecting pins adjacent to the exterior surface of said timing belt have a circular cross-section and the pin tapers to a point at its free end.

5. The pin feed tractor assembly of claim 1 wherein the base portion of each of said projecting pins adjacent to the exterior surface of said timing belt is a cylindrical section and the remainder of each pin is a dome-shaped section whereby the exterior surface of the dome-shaped section joins the surface of said cylindrical section along said surfaces forming a smooth transition along the line where they merge.

6. The pin feed tractor assembly of claim 5 wherein the tapered surface of each projecting pin has a convex curvature.

7. The pin feed tractor assembly of claim 5 wherein the dome-shaped section of each projecting pin is a dome whose lower surface joining the cylindrical section is tangential to the surface of the cylindrical section.

8. The pin feed tractor assembly of claim 5 further comprising a door swingably mounted to said frame;

said door having an elongated slot extending along the path of movement of said projecting pins to enable the projecting pins to extend into said slot when the door is moved to the closed position immediately above said belt.

9. The pin feed tractor assembly of claim 8 wherein said web passes between said frame and said door when said door is closed, said door having a surface portion which engages a surface portion of said frame to separate the door and frame and thereby provide a gap in the region through which said web passes, the width of said gap being adapted to permit the web to freely pass through said gap to enhance smooth feeding of the web.

10. The pin feed tractor assembly of claim 1 wherein said frame is comprised of first and second frame members each having a pair of spaced openings;

said first frame member having an integral spacer projection arranged between the pairs of openings in said first frame member and extending outwardly from one surface thereof;

said first frame member having fastener receiving openings extending through the first frame member in the region between said pairs of openings;

said second frame member having cooperating fastener receiving openings therethrough said aligned with the fastener receiving openings in said first frame member when said members are joined;

said spacer projection maintaining the portions of said first and second frame members containing said pairs of openings a spaced distance apart;

said sprockets each having a toothed portion and first and second cylindrical projections extending outwardly on opposing sides of the toothed portion thereby each cylindrical projection extends into and is slidably received by one of the pairs of openings in said first and second frame members so that said sprockets are freely rotatably mounted by said first and second frame members.

11. The tractor assembly of claim 10 wherein one end of each of said first and second frame members respectively has first and second doors pivotally mounted thereto;

each of said first and second doors having an elongated slot extending between said sprockets for enabling said projecting pins to enter said elongated slot as the projecting pins pass between said sprockets.

12. The tractor assembly of claim 11 wherein said frame members are each provided with central apertures intermediate their ends;

said central apertures being aligned to receive a rod which may be extended therethrough;

releasable clamping means mounted to one of said frame members for clamping said tractor assembly to the rod extending through said central opening.

13. The pin feed tractor assembly of claim 10 wherein the sidewalls of said spacer projection are recessed from the adjacent sidewalls of said first and second frame members to slidably support the inner surface of said belt so that the outer surface of said belt is substantially coplanar with the said adjacent sidewalls of said first and second frame members.

14. A pin feed tractor assembly for positively feeding a web having spaced perforations, said assembly comprising: pin means movable into said perforations to advance said web;

first means for urging said web towards said pins;

first and second cooperating contacts;

said first contact being supported by first resilient spring means;

said first means having an opening, said first resilient spring means having a bent portion biased to move into the opening in said first means in the absence of a web to move said one contact away from the remaining contact to provide a paper out indication.

15. The assembly of claim 14 wherein said pin means further comprises a first and second substantially linear paths of moving pins;

said first path arranged adjacent to said first means;

second means being positioned to urge said web towards the pins moving along said second path;

said second means having an opening;

second resilient spring means supporting said second contact and having a bent portion movable into the opening in said second means when said web is absent from the region of said second path for moving said second contact away from said first contact to provide a paper out indication.

16. The pin feed tractor assembly of claim 14 further comprising first means for resiliently mounting said first contact to said first spring means.

17. The pin feed tractor assembly of claim 15 further comprising first and second means for respectively resiliently mounting said first and second contacts to said first and second spring means.

18. A web motion sensing means for use with web feeding means for feeding edge perforated webs, comprising a housing having at least one light emitting means and one light sensing means;

an opening along a first side of said housing, said light emitting means being adapted to emit light directed towards said opening and said light sensing means being adapted to sense light entering said opening;

a first guide member spaced from the side of said housing to form a gap space of a gap thickness sufficient to enable said web to freely pass therethrough;

said opening being aligned with the perforations in said web which pass said housing opening as the web is advanced by said web feeding means;

said light sensing means sensing light of a first intensity when the web passes said housing opening and sensing light of a second intensity when a perforation in said web passes said housing opening.

19. The web motion sensing means of claim 18 wherein the surface of said guide member confronting the opening in said sensor means housing has a reflectivity different from the reflectivity of the surface of said web, said light sensing means being adapted to sense light reflected from the surface of said guide means when a perforation in said web passes the opening in the housing of said sensing means.

20. The web motion sensing means of claim 18 wherein the surface of said guide member confronting the opening in said sensor means housing has a reflectivity greater than the reflectivity of the surface of said web, said light sensing means being adapted to sense light reflected from the surface of said guide member when a perforation in said web passes the opening in the housing of said sensing means.

21. The web motion sensing means of claim 18 wherein the surface of said guide member confronting the opening in said sensor means housing has a reflectivity less than the reflectivity of the surface of said web, said light sensing means being adapted to sense light reflected from the surface of said guide member when a perforation in said web passes the opening in the housing of said sensing means.

22. The web motion sensing means of claim 18 further comprising a second sidewall in said housing opposite said first sidewall and having an opening aligned with the path of movement of perforations in a web passing said second sidewall;

second light emitting means for directing light towards the opening in said second sidewall;

second light sensing means for receiving light entering into the opening in said second wall;

a second guide member spaced from said second sidewall to form a gap space of a gap thickness sufficient to enable said web to freely pass therethrough; and the opening in said second sidewall is arranged to cause said second sensing means to sense when a perforation in the web is aligned with said opening in said second sidewall when the web passes the opening in said first sidewall and vice versa.

23. The web motion sensing means of claim 18 wherein said guide means is adapted to block ambient light from entering the opening in said first sidewall.

24. The web motion sensing means of claim 22 wherein said first and second guide means are adapted to block ambient light from entering the openings in said first and second sidewalls.

25. The web motion sensing means of claim 18 wherein said web feeding means comprises a pin feed tractor assembly having first and second frame members arranged in spaced parallel fashion and each having at least one sensor mounting opening;

said motion sensing means housing at least a pair of resilient projections extending outwardly from said housing for snap-fitting insertion into said sensor mounting opening to releasably mount said web motion sensing means housing to said pin feed tractor assembly.

26. The assembly of claim 14 wherein said first means comprises pivotally mounted door means to facilitate placement of a web upon said housing when open and to urge said web against said opening when closed.

* * * * *

UNITED STATES PATENT AND TRADEMARK OFFICE

CERTIFICATE OF CORRECTION

PATENT NO. : 4,214,691
DATED : July 29, 1980
INVENTOR(S) : Frederik T. van Namen It is certified that error appears in the above—identified patent and that said Letters Patent is hereby corrected as shown below:

Column 4, line 40, after "belt", insert --60--.

Column 4, line 48, change "to" to -- so --.

Column 5, line 12, change "39f" to --39f'--.

Column 5, line 34, change "39cof" to --39c of--.

Column 5, line 64, change "42a" to --42b--.

Column 6, line 2, after "50f", insert --,--.

Column 6, line 3, change "50f" to --50f'--.

Column 6, line 12, after "50", insert --,--.

Column 7, line 5, change "in" (second occurrence) to --is--.

UNITED STATES PATENT AND TRADEMARK OFFICE

CERTIFICATE OF CORRECTION

PATENT NO. : 4,214,691

DATED : July 29, 1980

INVENTOR(S) : Frederik T. van Namen

It is certified that error appears in the above—identified patent and that said Letters Patent is hereby corrected as shown below:

Column 8, line 43, change "101a" to --103a--.

Column 10, line 21, change "housinb" to --housing--.

Column 10, line 57, change "examle" to --example--.

Claim 1, line 26, change "t" to --the--.

Claim 10, line 17, change "said" to --and--.

Claim 10, line 26, change "thereby" to --whereby--.

Claim 19, line 45, change "means" to --member--.

Signed and Sealed this

Twelfth Day of May 1981

[SEAL]

Attest:

RENE D. TEGTMEYER

Attesting Officer

Acting Commissioner of Patents and Trademark